US010377967B2

(12) United States Patent
Schymitzek et al.

(10) Patent No.: US 10,377,967 B2
(45) Date of Patent: Aug. 13, 2019

(54) TRANSPARENT FABRIC CARE COMPOSITIONS

(71) Applicant: Henkel AG & Co. KGaA, Duesseldorf (DE)

(72) Inventors: Tatiana Schymitzek, Krefeld (DE); Simon Pluszynski, Wuppertal (DE); Ulrich Platzbecker, Duesseldorf (DE); Peter Schmiedel, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 47 days.

(21) Appl. No.: 15/539,837

(22) PCT Filed: Dec. 10, 2015

(86) PCT No.: PCT/EP2015/079286
§ 371 (c)(1),
(2) Date: Jun. 26, 2017

(87) PCT Pub. No.: WO2016/096614
PCT Pub. Date: Jun. 23, 2016

(65) Prior Publication Data

US 2018/0094213 A1 Apr. 5, 2018

(30) Foreign Application Priority Data

Mar. 10, 2002 (DE) ..... 10 2015 204 206
Dec. 17, 2014 (DE) ..... 10 2014 226 192

(51) Int. Cl.

| | |
|---|---|
| ***C11D 3/00*** | (2006.01) |
| ***C11D 1/62*** | (2006.01) |
| ***C11D 11/00*** | (2006.01) |
| ***C11D 3/22*** | (2006.01) |
| ***C11D 3/37*** | (2006.01) |
| *C11D 1/72* | (2006.01) |
| *C11D 1/835* | (2006.01) |

(52) U.S. Cl.
CPC ..... *C11D 3/0015* (2013.01); *C11D 1/62* (2013.01); *C11D 3/001* (2013.01); *C11D 3/222* (2013.01); *C11D 3/3742* (2013.01); *C11D 3/3773* (2013.01); *C11D 11/0017* (2013.01); *C11D 1/72* (2013.01); *C11D 1/835* (2013.01)

(58) Field of Classification Search
None
See application file for complete search history.

(56) References Cited

U.S. PATENT DOCUMENTS

| | | | | |
|---|---|---|---|---|
| 5,349,106 | A | 9/1994 | Behler et al. | |
| 5,670,677 | A | 9/1997 | Ponsati Obiols et al. | |
| 2002/0175310 | A1* | 11/2002 | Messner | D06M 15/6436 252/8.61 |
| 2003/0130162 | A1* | 7/2003 | Llosas | A61K 8/345 510/515 |
| 2006/0030513 | A1* | 2/2006 | Binder | C11D 3/162 510/515 |
| 2006/0135399 | A1* | 6/2006 | Grandmaire | C11D 1/62 510/515 |
| 2011/0190190 | A1* | 8/2011 | Schubert | C08G 77/388 510/329 |
| 2012/0030882 | A1* | 2/2012 | Wetrosky | C11D 1/62 8/137 |
| 2012/0324652 | A1* | 12/2012 | Christensen | C11D 1/62 8/137 |
| 2014/0308229 | A1* | 10/2014 | Bouzeloc | C08K 5/06 424/70.122 |

FOREIGN PATENT DOCUMENTS

| | | | |
|---|---|---|---|
| DE | 4409322 | C1 | 4/1995 |
| DE | 19751151 | A1 | 5/1999 |
| EP | 1136471 | A1 | 9/2001 |
| FR | 1156513 | A | 5/1958 |
| GB | 839407 | | 6/1960 |
| GB | 873214 | | 7/1961 |
| GB | 962919 | | 7/1964 |
| GB | 1333475 | | 10/1973 |
| WO | 9101295 | A1 | 2/1991 |
| WO | 0147489 | A1 | 7/2001 |
| WO | 2005073358 | A1 | 8/2005 |
| WO | 2013032493 | A1 | 3/2013 |

OTHER PUBLICATIONS

EPO, International Search Report and Written Opinion issued in International Application No. PC/EP2015/079286, dated Feb. 29, 2016.

Bilbo, R. et al., "Amphoteric Surfactants; A Structure Function Study," Soap/Cosmetics/Chemical Specialties for Apr. 1990, pp. 46, 48, 50, 114 & 116.

Wenninger, J.A. et al., "International Cosmetic Ingredient Dictionary and Handbook", Seventh Edition, 1997, pp. 686-688, 2722-2725, 2272-2274, vol. 1, The Cosmetic, Toiletry, and Fragrance Association, Washington DC, USA.

Ellis, P.R. et al., "Amphoteric Surfactants—The Next Generation," Euro Cosmetics, pp. 14-16.

Grabenhofer, R., "Film-former Silicone Emulsions for Hair", May 2012, Cosmetics & Toiletries Science Applied.

Griffin, W.C., "Classification of Surface-Active Agents by "HLB"," Journal of the Society of Cosmetic Chemists, 1949, pp. 311-326.

(Continued)

*Primary Examiner* — Katie L. Hammer
(74) *Attorney, Agent, or Firm* — Lorenz & Kopf, LLP

(57) ABSTRACT

The present disclosure relates to fabric care agents and fabric softener formulations with clear, transparent optical qualities and a viscous consistency, comprising a combination of specific esterquats with at least one non-ionic or cationic thickener and at least one aminosiloxane, and to the use of these fabric care compositions and fabric softener formulations. The present disclosure further relates to the use of a combination of specific esterquats with at least one non-ionic or cationic thickener and at least one aminosiloxane for preparing said fabric care agents and fabric softener formulations.

17 Claims, No Drawings

(56) References Cited

OTHER PUBLICATIONS

Holzman, S., et al. "Amphoteric Surfactants—Amphoteric Surfactants of the Amphoglycinate and Amphocarboxyglycinate Type," Tenside Detergents 1986, pp. 309-313.
Wenninger, J.A. et al., "International Cosmetic Ingredient Dictionary and Handbook", Seventh Edition, 1997, vol. 1 Table of Contents, and vol. 2 Table of Contents, The Cosmetic, Toiletry, and Fragrance Association, Washington DC, USA.
O'Lenick, A.J. Jr. et al., "Amphoteric Surfactants—A Review of the Chemistry and Applications," HAPPI, Nov. 1986, pp. 70-74, and 125-126.
Ploog, U., "Aerosols Cosmetics Fragrances," Magazine for the Body Care Products Perfumery, and Aerosol-Industry, Jul. 1982, pp. 373-378.

* cited by examiner

TRANSPARENT FABRIC CARE COMPOSITIONS

CROSS-REFERENCE TO RELATED APPLICATION

This application is a U.S. National-Stage entry under 35 U.S.C. § 371 based on International Application No. PCT/EP2015/079286, filed Dec. 10, 2015, which was published under PCT Article 21(2) and which claims priority to German Application No. 10 2014 226 192.9, filed Dec. 17, 2014, and German Application No. 10 2015 204 206.5, filed Mar. 10, 2015, which are all hereby incorporated in their entirety by reference.

TECHNICAL FIELD

The present disclosure relates to fabric care agents and fabric softener formulations with clear, transparent optical qualities and a viscous consistency, as well as to the use of these fabric care agents and fabric softener formulations.

BACKGROUND

"Esterquats" (EQ), the term generally being understood as meaning quaternized fatty acid triethanolamine ester salts, are widely suitable for softening both fibers and also hair and, in former years, have pushed conventional quaternary ammonium compounds, such as, for example, the known distearyldimethyl ammonium chloride, largely out of the market as a result of their better ecotoxicological compatibility.

Although the known esterquats have very favorable properties for industrial use and possess satisfactory biodegradability and favorable cosmetic compatibility with the skin, the preparations with esterquats that are known in the prior art have a disadvantage in being turbid. Though specific esterquats based on unsaturated fatty acids, with which optically clear formulations can be prepared, are available on the market, high concentrations of these esterquats are needed, as is the use of solvents, in order to be able to prepare clear fabric softener formulations that have the desired properties. This, in turn, is detrimental in terms of the costs of such formulations.

It is moreover desirable for such formulations to be viscous, without forming filaments, in order to enable simple handling and dosing. Finally, there are also considerable requirements regarding the stability of such formulations, because not only is a consistent usage-specific quality desired, but so too is the longest-lasting possible visually and olfactorily appealing structure of the product.

BRIEF SUMMARY

Liquid, clear, homogeneous fabric treatment agents and methods of treating fabric with the agents are provided herein. In an embodiment, a liquid, clear, homogeneous fabric treatment agent includes:

a. at least one cationic compound that can be obtained by reacting i. a mixture of at least one dicarboxylic acid of formula (I)

Formel (I)

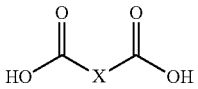

wherein X stands for a saturated or unsaturated hydrocarbon residue having 1 to 8 carbon atoms, and at least one monocarboxylic acid of formula (II)

Formel (II)

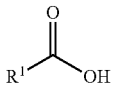

wherein $R^1$ stands for a saturated or unsaturated hydrocarbon residue having 5 to 21 carbon atoms, and ii. at least one tertiary amine of formula (III)

Formel (III)

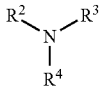

wherein $R^2$, $R^3$, and $R^4$—independently of one another—stand for a $C_2$ to $C_6$ hydroxyalkyl group, in particular, 2-hydroxyethyl, and then reacting the resulting product and iii. at least one quaternizing agent for quaternizing at least one amino group included in the reaction product, and b. at least one non-ionic or cationic thickener, and c. at least one aminosiloxane.

In another embodiment, a method includes treating fabric with a liquid, clear, homogeneous, and fabric-softening fabric treatment agent, wherein the agent comprises:

a. at least one cationic compound (EQ) that can be obtained by reacting i. a mixture of at least one dicarboxylic acid of formula (I)

Formel (I)

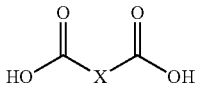

wherein X stands for a saturated or unsaturated hydrocarbon residue having 1 to 8 carbon atoms, and at least one monocarboxylic acid of formula (II)

Formel (II)

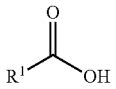

wherein $R^1$ stands for a saturated or unsaturated hydrocarbon residue having 5 to 21 carbon atoms, and ii. at least one tertiary amine of formula (III)

Formel (III)

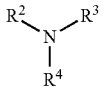

wherein $R^2$, $R^3$, and $R^4$—independently of one another—stand for a $C_2$ to $C_6$ hydroxyalkyl group, in particular, 2-hydroxyethyl, and and then reacting the resulting product and iii. at least one quaternizing agent for quaternizing at least one amino group included in the reaction product, and b. at least one non-ionic or cationic thickener, and c. at least one aminosiloxane selected from the group of amodimethicone/morpholinomethyl silsesquioxane copolymer, trideceth-9 PG-amodimethicone, with methylsilsesquioxane hydroxy-limited dimethyl methyl(aminoethylaminoisobutyl)siloxane, or dimethyl methyl (aminoethylaminoisobutyl)siloxane, in particular, amodimethicone/morpholinomethyl silsesquioxane copolymer.

DETAILED DESCRIPTION

The following detailed description is merely exemplary in nature and is not intended to limit the disclosure or the application and uses of the subject matter as described herein. Furthermore, there is no intention to be bound by any theory presented in the preceding background or the following detailed description.

The present disclosure solves the problem of providing transparent, viscous compositions containing esterquats, which at least partially overcome the above-described disadvantages of known formulations. The present disclosure is based on the surprising finding that combining specific esterquats and cationic thickeners with aminosiloxanes yields an optically clear, viscous fabric softener formulation with a simultaneously reduced concentration of softening substances—relative to comparable market formulations—that has a high storage stability (no clouding, no unpleasant odor formation).

In a first aspect, therefore, the present disclosure relates to a liquid, clear, homogeneous fabric treatment agent, in particular, fabric softener formulation, comprising a. at least one cationic compound (EQ) that can be obtained by reacting i. a mixture of at least one dicarboxylic acid of formula (I)

Formel (I)

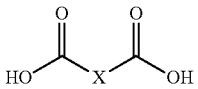

wherein X stands for a saturated or unsaturated hydrocarbon residue having 1 to 8 carbon atoms, and at least one monocarboxylic acid of formula (II)

Formel (II)

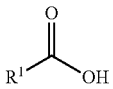

wherein $R^1$ stands for a saturated or unsaturated hydrocarbon residue having 5 to 21 carbon atoms, with ii. at least one tertiary amine of formula (III)

Formel (III)

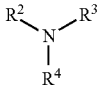

wherein $R^2$, $R^3$, and $R^4$—independently of one another—stand for a $C_2$ to $C_6$ hydroxyalkyl group, in particular, 2-hydroxyethyl, and then reacting the resulting product with iii. at least one quaternizing agent for quaternizing at least one amino group contained in the reaction product, and b. at least one non-ionic or cationic thickener, and c. at least one aminosiloxane.

Another aspect of the present disclosure relates to the use of a. at least one cationic compound (EQ) that can be obtained by reacting i. a mixture of at least one dicarboxylic acid of formula (I)

Formel (I)

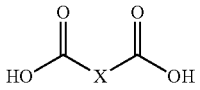

wherein X stands for a saturated or unsaturated hydrocarbon residue having 1 to 8 carbon atoms, and at least one monocarboxylic acid of formula (II)

Formel (II)

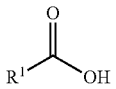

wherein $R^1$ stands for a saturated or unsaturated hydrocarbon residue having 5 to 21 carbon atoms, with ii. at least one tertiary amine of formula (III)

Formel (III)

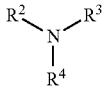

wherein $R^2$, $R^3$, and $R^4$—independently of one another—stand for a $C_2$ to $C_6$ hydroxyalkyl group, in particular, 2-hydroxyethyl, and then reacting the resulting product with iii. at least one quaternizing agent for quaternizing at least one amino group contained in the reaction product, and b. at least one non-ionic or cationic thickener, and c. at least one aminosiloxane, at least one aminosiloxane selected from the group of amodimethicone/morpholinomethyl silsesquioxane copolymer, trideceth-9 PG-amodimethicone, with methylsilsesquioxane hydroxy-limited dimethyl methyl(aminoethylaminoisobutyl) siloxane and dimethyl methyl (aminoethylaminoisobutyl)siloxane, in particular, amodimethicone/morpholinomethyl silsesquioxane copolymer, to prepare liquid, clear, homogeneous, and fabric-softening fabric treatment agents.

These and further aspects, features, and advantages of the present disclosure become apparent to a person skilled in the art when studying the following detailed description and claims. Every feature from one aspect of the present disclosure may be used in any another aspect of the present disclosure. Moreover, it shall be readily understood that the examples contained herein are intended to describe and illustrate the present disclosure, but do not limit the same, and in particular the present disclosure is not limited to these examples. All percentage information is percent by weight, unless indicated otherwise. Numerical ranges indicated in the format "from x to y" include the mentioned values. If several preferred numerical ranges are indicated in this format, it shall be readily understood that all ranges resulting from the combination of the different end points are likewise covered. In addition, amounts relating to at least one component always signify the total amount of that type of component that is contained in the composition, unless explicitly otherwise noted. This means that such amounts, e.g., in connection with "at least one emulsifier", refer to the total amount of emulsifiers contained in the washing agent.

Whenever alkaline earth metals are mentioned below as counterions for monovalent anions, this means that the alkaline earth metal is, of course, only present in half the molar quantity (sufficient for charge balancing) as the anion.

Substances which also serve as ingredients of cosmetic agents are sometimes referred to below in accordance with the International Nomenclature Cosmetic Ingredient (INCI) nomenclature. Chemical compounds bear an INCI name in English, vegetable ingredients are listed exclusively in accordance with Linné in Latin. So-called trivial names such as "water", "honey", or "sea salt" are likewise given in Latin. The INCI names can be found in the "International Cosmetic Ingredient Dictionary and Handbook, Seventh Edition (1997)", which is published by The Cosmetic, Toiletry and Fragrance Association (CTFA), 1101, 17th Street NW, Suite 300, Washington, D.C. 20036, U.S.A., and contains more than 9,000 INCI names and cross references to more than 37,000 trade names and industrial names including the relevant distributors from more than 31 countries. The International Cosmetic Ingredient Dictionary and Handbook assigns the ingredients to one or more Chemical Classes, for example "Polymeric Ethers", and to one or more Functions, for example "Surfactants—Cleansing Agents", which it explains in turn in more detail. Where appropriate, reference is likewise made to this below.

The designation CAS means that the following numerical sequence is a Chemical Abstracts Service notation.

"At least one", as used herein, refers to one or more, for example, two, three, four, five, six, seven, eight, nine, or more. In the context of components of the compositions described herein, this information refers not to the absolute amount of molecules, but rather to the type of the component. "At least one emulsifier" therefore signifies, for example, one or more different emulsifiers, i.e., one or more different types of emulsifiers. Together with quantities, the quantities refer to the total amount of the correspondingly-designated type of component, as defined above.

"Liquid", as used herein, includes all compositions—inclusive of appropriate pastes and gels—that are flowable at standard conditions (20° C. and 1,013 mbar).

"Clear", as used in the context of the agents described, signifies that they are optically transparent and unclouded, i.e., have NTU values in the range of 0 to 30, in particular, 0 to 25. The Nephelometric Turbidity Unit (NTU) is a unit used in water treatment to measure the turbidity of liquids. It is the unit of the turbidity of a liquid as measured with a calibrated nephelometer at an angle of 90° and a wavelength of measurement radiation in the infrared range, at 860 nm (according to ISO 7027).

"Homogeneous", as used herein, refers to the agents being single-phase liquid agents, i.e., those which are clear according to the above-mentioned definition and in which no phase separation of two or more liquid phases is observed. For this purpose, it is preferable for all of the ingredients used to be soluble at a temperature between about 5° C. and about 80° C., preferably between about 20° C. and about 65° C., and a pH value between about 1 and about 8, preferably between about 1 and about 4, in water or a solvent system having a water content between about 50 and about 95% by volume. "Soluble", as used in this context, refers to the relevant component being completely soluble in the liquid phase of the agent at the concentration used, so that the agent remains clear and does not undergo opacification. Typically, this requires solubility (at 20° C.) of at least about 1 g/L solvent, preferably at least about 10 g/L solvent, still more preferably at least about 50 g/L solvent.

The pH value, as set forth herein, refers to the pH value as determined at 25° C., unless explicitly otherwise noted.

Examples of dicarboxylic acids that in principle are considered as starting materials within the meaning of the present disclosure include those of formula (I), in which X stands for an optionally hydroxy-substituted linear or branched alkyl or alkylene group having 2 to 8 carbon atoms. Preferably, X stands for ethan-1,2-diyl, propan-1,2-diyl, propan-1,3-diyl, butan-1,4-diyl, hexan-1,4-diyl, or cyclohexan-1,4-diyl, especially preferably butan-1,4-diyl. Typical examples for suitable dicarboxylic acids include but are not limited to succinic acid, maleic acid, glutaric acid, and, in particular, adipic acid. Mixtures of the foregoing acids may also be used.

In the monocarboxylic acids of formula (II), $R^1CO$ preferably stands for an aliphatic, linear, or branched acyl residue having 6 to 22 carbon atoms and 0 and/or 1, 2, or 3 double bonds. Typical examples include, but are not limited to, caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselic acid, linoleic acid, linolenic acid, eleostearic acid, arachidic acid, gadoleic acid, behenic acid, and erucic acid, and industrial mixtures thereof which are produced, for example, during the pressurized cleavage of natural fats and oils, during the reduction of aldehydes from the Roelen oxo synthesis, or the dimerization of unsaturated fatty acids. Stearic acid, isostearic acid, palmitic acid, myristic acid, lauric acid, capric acid, caprylic acid, 2-ethylhexanoic acid, 2-octyldodecanoic acid, caproic acid, oleic acid, linoleic acid, and linolenic acid are preferred, as are—each preferably in hydrogenated or partially-hydrogenated form—coconut fatty acid, palm fatty acid, palm kernel fatty acid, and tallow fatty acid. Mixtures of two or more of the aforementioned acids can also be used.

In various embodiments of the present disclosure, succinic acid, maleic acid, glutaric acid, adipic acid, or mixtures thereof are selected as the dicarboxylic acid of formula (I), and/or stearic acid, isostearic acid, palmitic acid, myristic acid, lauric acid, capric acid, caprylic acid, 2-ethylhexanoic acid, 2-octyldodecanoic acid, caproic acid, oleic acid, linoleic acid, linolenic acid, partially-hydrogenated coconut fatty acid, palm fatty acid, palm kernel fatty acid, tallow fatty acid, and mixtures of two, three, or more of aforementioned acids are selected as the monocarboxylic acid of formula (II).

Alkanolamines of formula (III), which are suitable as central nitrogen compounds within the meaning of the present disclosure, contain a hydroxyalkane residue (alkanol residue) having 2 to 6 carbon atoms, preferably 2 to 4 carbon atoms. Preferably, triethanolamine is used.

The monocarboxylic acids (of formula II) and the dicarboxylic acids (of formula I) may be used in the molar ratio of from about 1:10 to about 10:1. It has, however, proven advantageous to use a molar ratio of from about 1:1 to about 4:1 and, in particular, from about 1.5:1 to about 3:1.

The trialkanolamines on the one hand and the acids on the other—i.e., the sum of mono- and dicarboxylic acids—may be used in the molar ratio of from about 1:1.2 to about 1:2.4. A molar ratio trialkanolamine:acids of from about 1:1.5 to about 1:1.8 has proven to be optimal.

Manufacturing methods for preparing the esterquats used according to the present disclosure are generally known in the prior art. In particular, the esterification can be performed in a known manner, e.g., such as is described in international patent application WO 91/01295. Advantageously, the esterification is performed at temperatures of from about 120° C. to about 220° C., in particular, from about 130° C. to about 170° C., and pressures of from about 0.01 to about 1 bar. Suitable catalysts are hypophosphorous acids and alkali salts thereof, preferably sodium hypophosphite, which may be used in amounts of from about 0.01 to about 0.1% by weight, preferably from about 0.05 to about 0.07% by weight, relative to the starting materials. In the interests of particularly high color quality and stability, it has proved to be of advantage to use alkali metal and/or alkaline earth metal borohydrides, for example potassium, magnesium, and, in particular, sodium borohydride, as co-catalysts. The co-catalysts are normally used in amounts of from about 50 to about 1000 ppm and, in particular, in amounts of from about 100 to about 500 ppm, again relative to the starting materials. Corresponding processes are also the subject of German patent documents DE 4308792 C1 and DE 4409322 C1, to the teachings of which reference is hereby specifically made. Mixtures of the monocarboxylic acids and dicarboxylic acids may be used in the esterification or, alternatively, the esterification may be carried out with the two components in successive steps.

The monocarboxylic acid/dicarboxylic acid trialkanolamine esters may be quaternized in a known manner. Although the reaction with the alkylating agents can also be performed in the absence of solvents, it is advisable to make concurrent use of at least small quantities of water or lower alcohols, preferably isopropyl alcohol, to prepare concentrates having a solid content of at least about 80% by weight, in particular, at least about 90% by weight.

Suitable alkylating agents are alkyl halides such as, for example, methyl chloride, dialkyl sulfates, e.g., dimethyl sulfate or diethyl sulfate, or dialkyl carbonates, such as dimethyl carbonate or diethyl carbonate. The esters and the alkylating agents are normally used in a molar ratio of from about 1:0.95 to about 1:1.05, i.e. in a substantially stoichiometric ratio. The reaction temperature is usually in the range from about 40° C. to about 80° C., and, more particularly, in the range from about 50° C. to about 60° C. After the reaction, it is advisable to destroy unreacted alkylating agent by addition of, for example, ammonia, an (alkanol)amine, an amino acid or an oligopeptide, as described for example in German patent application DE 4026184 A1. In preferred embodiments, the quaternizing agent is dimethyl sulfate.

In an especially preferred embodiment, the at least one cationic compound comprises or is composed of an esterquat compound of formula (K1)

(K1)

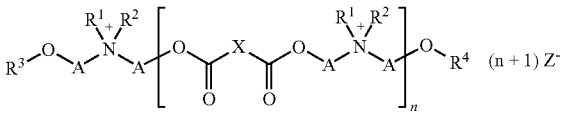

wherein, X stands for a saturated or unsaturated hydrocarbon residue having 1 to 10 carbon atoms, in particular, for butan-1,4-diyl; A stands for a ($C_2$ to $C_6$) alkanediyl group, in particular, for ethan-1,2-diyl; $R^1$ for a ($C_2$ to $C_4$) hydroxyalkyl group or a ($C_6$ to $C_{22}$) acyloxy ($C_2$ to $C_4$) alkyl group, in particular, for 2-hydroxyethyl or 2-(($C_6$ to $C_{22}$) acyloxy) ethyl; $R^2$ for methyl or ethyl; $R^3$ and $R^4$—independently of one another—stand for a hydrogen atom or a ($C_6$ to $C_2$) acyl group; n stands for 1 or 2; and $Z^-$ stands for any anion, in particular, methyl sulfate, with the proviso that according to formula (K1), at least one of the groups $R^1$, $R^3$, or $R^4$ comprises a ($C_6$ to $C_{22}$) acyl residue.

The esterquats used according to the present disclosure are ideally liquid to pasty at temperatures around 20° C.

The agents according to the present disclosure may contain the esterquats in amounts of from about 2 to about 60% by weight, preferably from about 2 to about 30% by weight—relative to the total amount of the liquid composition—in the final product.

Suitable thickening agents are, for example, Aerosil® types (hydrophilic silicas), polysaccharides, more especially xanthan gum, guar guar, agar agar, alginates and tyloses, carboxymethyl cellulose, methyl cellulose, and hydroxypropyl-, hydroxypropylmethyl-, and hydroxyethyl cellulose, also relatively high molecular weight polyethylene glycol monoesters and diesters of fatty acids (e.g. Eumulgin® EO 33 from BASF), polyacrylates (e.g. Carbopols® from Goodrich or Synthalene® from Sigma), polyacrylamides, polyvinyl alcohol, and polyvinylpyrrolidone, surfactants such as, for example, ethoxylated fatty acid glycerides, esters of fatty acids with polyols such as, for example, pentaerythritol or trimethylolpropane, fatty alcohol ethoxylates with a narrowed homolog distribution, or alkyloligoglucosides, and electrolytes such as sodium chloride and ammonium chloride.

In various embodiments, the at least one thickener is a non-ionic thickener, in particular, is selected from the group of hydroxyethyl cellulose (HEC), hydroxypropyl cellulose (HPC), hydroxypropyl methylcellulose (HPMC), methylcellulose (MC), guar, guar derivatives (e.g., Jaguar HP105 (Rhodia), hydroxypropyl guar), and mixtures of the aforementioned non-ionic thickeners.

In various embodiments of the present disclosure, the at least one thickener is a cationic copolymer. Such a copolymer may be composed of or contain at least one monomer of formula (M1) and at least one monomer of formula (M2).

(M1)

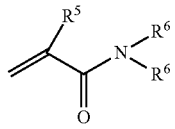

(M2)

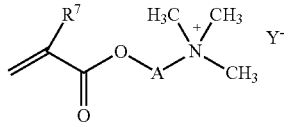

wherein $R^5$, $R^6$, and $R^7$—independently of one another—stand for hydrogen or a methyl group, A stands for ethan-1,2-diyl or propan-1,3-diyl, and $Y^-$ stands for any anion.

Preferably, said copolymer is composed from about 95 to about 100% of the monomers of formula (M1) and (M2), relative to the total weight of the polymer. In addition, the copolymer is present in a covalently cross-linked form in preferred embodiments. This covalent cross-linking is produced with the use of at least one copolymerizable cross-linking agent. Suitable copolymerizable cross-linking agents bear at least two ethylenically unsaturated groups and are, in particular, selected from divinylbenzene, tetraallylammonium chloride, allyl acrylate, allyl methacrylate, diacrylate compounds of glycols, diacrylate compounds of polyglycols, dimethacrylate compounds of glycols, dimethacrylate compounds of polyglycols, butadiene, 1,7-octadiene, allylacrylamide, allylmethacrylamide, bisacrylamidoacetic acid, N,N'-methylenebisacrylamide, polyol polyallyl ether, and mixtures of two or more of these compounds.

The copolymer may be obtained, for example, by emulsion polymerization. In preferred embodiments, the copolymer is present in the form of beads, the beads preferably having an average particle diameter of from about 10 to about 1,000 μm, in particular, from about 50 to about 1,000 μm.

In various preferred embodiments, the at least one thickener is a cationic copolymer that is covalently cross-linked with the use of at least one copolymerizable cross-linking agent with at least two ethylenically unsaturated groups, in particular, selected from divinylbenzene, tetraallylammonium chloride, allyl acrylate, allyl methacrylate, diacrylate compounds of glycols, diacrylate compounds of polyglycols, dimethacrylate compounds of glycols, dimethacrylate compounds of polyglycols, butadiene, 1,7-octadiene, allylacrylamide, allylmethacrylamide, bisacrylamidoacetic acid, N,N'-methylenebisacrylamide, polyol polyallyl ether, and mixtures of two, three, or more of these compounds, and/or has a structure of general formula (IV)

Formel (IV)

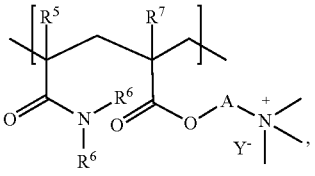

wherein $R^5$, $R^6$, and $R^7$—independently of one another—stand for hydrogen or a methyl group, A stands for ethan-1,2-diyl or propan-1,3-diyl, and $Y^-$ stands for any anion.

In various embodiments, $Y^-$ may be, for example, $RCOO^-$, $ClO_4^-$, $BF_4^-$, $PF_6^-$, $RSO_3^-$, $RSO_4^-$ (preferably $CF_3SO_3^-$), $SO_4^{2-}$, $OCN^-$, $SCN^-$, $NO_3^-$, $F^-$, $Cl^-$, $Br^-$, $I^-$, $RO^-$, $ClO_4^-$, $HSO_4^{2-}$, $PO_4^{3-}$, $HPO_4^{2-}$, $H_2PO_4^{2-}$, $CO_3^{2-}$ or $HCO_3^-$, wherein R is selected from the group of hydrogen, unsubstituted and substituted $C_{11}$-$C_{24}$ alkyl, and substituted aryl. In particular, $Y^-$ is selected from the group of $RSO_3^-$, $OCN^-$, $SCN^-$, $NO_3^-$, $F^-$, $I^-$, and $Cl^-$. $Y^-$ is preferably $Cl^-$.

Examples of suitable cationic thickeners include, e.g., those that are available under the trade name Rheovis® CSP (BASF).

In various embodiments, the at least one non-ionic or cationic thickener is contained in the agent in an amount of from about 0.1 to about 10% by weight relative to the total weight thereof.

In various embodiments of the present disclosure, the at least one aminosiloxane is selected from the group of Amodimethicone/Morpholinomethyl Silsesquioxane Copolymer (CAS No. 1293390-78-9), Trideceth-9 PG-Amodimethicone (CAS No. 943769-53-7), Methylsilsesquioxane Hydroxy-limited Dimethyl, methyl(aminoethylaminoisobutyl)siloxane (CAS No. 863918-80-3), and Dimethyl, methyl (aminoethylaminoisobutyl)siloxane (CAS No. 106842-44-8). Especially preferred is Amodimethicone/Morpholinomethyl Silsesquioxane Copolymer (CAS No. 1293390-78-9), which is commercially available as Belsil® ADM 8301 E (Wacker Chemie).

The aminosiloxane serve to improve the water absorption performance and the rewettability of the treated textiles, and to facilitate ironing of the treated textiles. In addition, the rinsing-out behavior of the agents according to the present disclosure is improved thereby, due to the suds-suppressing properties thereof.

In various embodiments of the present disclosure, the agent contains at least one emulsifier. The at least one emulsifier is preferably a non-ionic emulsifier and has an HLB value of at least about 12.0, preferably at least about 13.0, further preferably at least about 14.0, and most preferably at least about 15.0.

The term "HLB" (hydrophilic-lipophilic balance) defines the hydrophilic and lipophilic components of corresponding classes of substances (which here are emulsifiers) in a range of values from about 1 to about 20 according to the following formula (Griffin, Classification of surface active agents by HLB, J. Soc. Cosmet. Chem. 1, 1949):

$$HLB=20\times(1-(M_1/M))$$

where M=molar mass of the entire molecule
and $M_1$=molar mass of the lipophilic component of the molecule Low HLB values (≥1) describe lipophilic substances, whereas high HLB values (≤20) describe hydrophilic substances. Thus, for example, defoamers typically have HLB values in the range of from about 1.5 to about 3 and are insoluble in water. Emulsifiers for W/O emulsions typically have HLB values in the range of from about 3 to about 8, whereas emulsifiers for O/W emulsions typically have HLB values in the range of from about 8 to about 18. Wash-active substances typically have HLB values in the range of from about 13 to about 15, and solubilizers have values in the range of from about 12 to about 18.

The following non-ionic emulsifiers may be considered—though without limiting the present disclosure thereto—as non-ionic emulsifiers for the formulations according to the present disclosure:

addition products of 2 to 50 mol ethylene oxide and/or 0 to 5 mol propylene oxide to linear fatty alcohols having 8 to 22 C atoms, to fatty acids having 8 to 22 C atoms, to alkyl phenols having 8 to 15 C atoms in the alkyl group, and alkylamines having 8 to 22 carbon atoms in the alkyl residue; alkyl and/or alkenyl oligoglycosides having 8 to 22 carbon atoms in the alk(en)yl residue and ethoxylated analogs thereof;

addition products of 1 to 15 mol ethylene oxide to castor oil and/or hydrogenated castor oil;

addition products of from 15 to 60 mol of ethylene oxide onto castor oil and/or hydrogenated castor oil; partial esters of glycerol and/or sorbitol with unsaturated, linear or saturated, branched fatty acids having 12 to 22 carbon atoms and/or hydroxycarboxylic acids having 3 to 18 carbon atoms, and adducts thereof with 1 to 30 mol of ethylene oxide; partial esters of polyglycerol (average degree of self-condensation 2 to 8), polyethylene glycol (molecular weight from 200 to about 5000), trimethylolpropane, pentaerythritol, sugar alcohols (e.g. sorbitol), alkyl glucosides (e.g. methyl glucoside, butyl glucoside, lauryl glucoside), and polyglucosides (e.g. cellulose) with saturated and/or unsaturated, linear or branched fatty acids having 12 to 22 carbon atoms and/or hydroxycarboxylic acids having 3 to 18 carbon atoms, and adducts thereof with 1 to 30 mol of ethylene oxide;

mixed esters of pentaerythritol, fatty acids, citric acid, and fatty alcohol as in German Patent 1165574 PS and/or mixed esters of fatty acids having 6 to 22 carbon atoms, methyl glucose and polyols, preferably glycerol or polyglycerol.

mono-, di- and trialkyl phosphates, and also mono-, di- and/or tri-PEG alkyl phosphates and salts thereof;

wool wax alcohols;

polysiloxane-polyalkyl-polyether copolymers and corresponding derivatives;

polyalkylene glycols.

The addition products of ethylene oxide and/or propylene oxide onto fatty alcohols, fatty acids, alkyl phenols or onto castor oil are known, commercially available products. These are homolog mixtures having an average degree of alkoxylation that corresponds to the ratio of the quantitative amounts of ethylene oxide and/or propylene oxide and substrate with which the addition reaction is carried out. $C_{12-18}$ fatty acid mono- and diesters of addition products of ethylene oxide onto glycerol are known from German Patent DE 2024051 PS as refatting agents for cosmetic preparations.

Alkyl and/or alkenyl oligoglycosides, preparation thereof, and use thereof are known from the prior art. They are prepared, in particular, by reacting glucose or oligosaccharides with primary alcohols having 8 to 18 carbon atoms. So far as the glycoside unit is concerned, both monoglycosides in which a cyclic sugar residue is attached to the fatty alcohol by a glycoside bond and oligomeric glycosides with a degree of oligomerization of preferably up to about 8 are suitable. The degree of oligomerization is a statistical mean value on which the homolog distribution typical of such industrial products is based.

Typical examples of suitable partial glycerides are hydroxystearic acid monoglyceride, hydroxystearic acid diglyceride, isostearic acid monoglyceride, isostearic acid diglyceride, oleic acid monoglyceride, oleic acid diglyceride, ricinoleic acid monoglyceride, ricinoleic acid diglyceride, linoleic acid monoglyceride, linoleic acid diglyceride, linolenic acid monoglyceride, linolenic acid diglyceride, erucic acid monoglyceride, erucic acid diglyceride, tartaric acid monoglyceride, tartaric acid diglyceride, citric acid monoglyceride, citric acid diglyceride, malic acid monoglyceride, malic acid diglyceride and industrial mixtures thereof which may still contain small quantities of triglyceride from the production process. Addition products of 1 to 30 mol ethylene oxide, preferably 5 to 10 mol ethylene oxide onto the partial glycerides mentioned are also suitable.

Suitable sorbitan esters are sorbitan monoisostearate, sorbitan sesquiisostearate, sorbitan diisostearate, sorbitan triisostearate, sorbitan monooleate, sorbitan sesquioleate, sorbitan dioleate, sorbitan trioleate, sorbitan monoerucate, sorbitan sesquierucate, sorbitan dierucate, sorbitan trierucate, sorbitan monoricinoleate, sorbitan sesquiricinoleate, sorbitan diricinoleate, sorbitan triricinoleate, sorbitan monohydroxystearate, sorbitan sesquihydroxystearate, sorbitan dihydroxystearate, sorbitan trihydroxystearate, sorbitan monotartrate, sorbitan sesquitartrate, sorbitan ditartrate, sorbitan tritartrate, sorbitan monocitrate, sorbitan sesquicitrate, sorbitan dicitrate, sorbitan tricitrate, sorbitan monomaleate, sorbitan sesquimaleate, sorbitan dimaleate, sorbitan trimaleate, and industrial mixtures thereof. Addition products of 1 to 30 mol ethylene oxide, preferably 5 to 10 mol ethylene oxide onto the sorbitan esters mentioned are also suitable.

Typical examples of suitable polyglycerol esters are Polyglyceryl-2 Dipolyhydroxystearate (Dehymuls® PGPH), Polyglycerin-3-Diisostearate (Lameform® TGI), Polyglyceryl-4 Isostearate (Isolan® GI 34), Polyglyceryl-3 Oleate, Diisostearoyl Polyglyceryl-3 Diisostearate (Isolan® PDI), Polyglyceryl-3 Methylglucose Distearate (Tego Care® 450), Polyglyceryl-3 Beeswax (Cera Bellina®), Polyglyceryl-4 Caprate (Polyglycerol Caprate T2010/90), Polyglyceryl-3 Cetyl Ether (Chimexane® NL), Polyglyceryl-3 Distearate (Cremophor® GS 32) and Polyglyceryl Polyricinoleate (Admul® WOL 1403), Polyglyceryl Dimerate Isostearate and mixtures thereof.

Examples of other suitable polyol esters are the mono-, di- and triesters of trimethylolpropane or pentaerythritol with lauric acid, coconut fatty acid, tallow fatty acid, palmitic acid, stearic acid, oleic acid, behenic acid, and the like—optionally reacted with 1 to 30 mol ethylene oxide.

Instead of or in addition to the at least one non-ionic emulsifier, the agents according to the present disclosure may also contain other emulsifiers, e.g., cationic or anionic emulsifiers.

The known cationic emulsifiers include fatty acid amidoamines and/or the quaternization products thereof.

Fatty acid amidoamines suitable as cationic emulsifiers are condensation products of fatty acids having optionally ethoxylated diamines or oligoamines that preferably conform to formula (V), $$R^1CO—NR^2\text{-}[(A)\text{-}NR^3]n—R^4 \quad (V)$$

in which $R^1CO$ stands for a linear or branched, saturated or unsaturated acyl residue having 6 to 22 carbon atoms, $R^2$ stands for hydrogen or an optionally hydroxy-substituted alkyl radical having 1 to 4 carbon atoms, $R^3$ and $R^4$—independently of one another—stand for hydrogen, a $(CH_2CH_2O)_mH$ group, or an optionally hydroxy-substituted alkyl residue having 1 to 4 carbon atoms, A stands for a linear or branched alkylene group having 1 to 6 carbon atoms, n stands for a number from 1 to 4, and m stands for a number from 1 to 30. Typical examples are condensation products of caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselic acid, linoleic acid, linolenic acid, eleostearic acid, arachidic acid, gadoleic acid, behenic acid and erucic acid, and industrial mixtures thereof with ethylenediamine, propylenediamine, diethylenetriamine, dipropylenetriamine, triethylenetetramine, tripropylenetetramine, and adducts thereof with 1 to 30, preferably 5 to 15 and, in particular, 8 to 12, mol of ethylene oxide. The use of ethoxylated fatty acid amidoamines is preferred here because the hydrophilicity of the emulsifiers can in this way be adjusted exactly to the active ingredients to be emulsified. In place of the fatty acid amidoamines, it is also possible to use the quaternization products thereof, which are obtained by reacting the amidoamines with suitable alkylating agents, such as, for example, methyl chloride or, in particular, dimethyl sulfate, in accordance with processes known per se. The quaternization products preferably conform to formula (VI), $$[R^1CO—NR^2\text{-}[(A)\text{-}N^+(R^3R^6)]n—R^4]X^- \quad (VI)$$

in which $R^1CO$ stands for a linear or branched, saturated or unsaturated acyl residue having 6 to 22 carbon atoms; $R^2$ stands for hydrogen or an optionally hydroxy-substituted alkyl residue having 1 to 4 carbon atoms; $R^3$ stands for hydrogen, a $(CH_2CH_2O)_mH$ group, or an optionally hydroxy-substituted alkyl residue having 1 to 4 carbon atoms; $R^4$ stands for RICO, hydrogen, a $(CH_2CH_2O)_mH$ group, or an optionally hydroxy-substituted alkyl residue having 1 to 4 carbon atoms; $R^6$ stands for an alkyl residue having 1 to 4 carbon atoms; A stands for a linear or branched alkylene group having 1 to 6 carbon atoms; n stands for numbers from 1 to 4; m stands for numbers from 1 to 30; and X stands for halide, specifically chloride, or alkylsulfate, preferably methyl sulfate. Suitable for this purpose are, for example, the methylation products of the preferred fatty acid amidoamines already given above. In addition, it is also possible to use mixtures of fatty acid amidoamines and quaternization products thereof, which are prepared in a particularly simple manner by not carrying out the quaternization completely, but only to a desired degree.

The compositions according to the present disclosure may contain the fatty acid amidoamines and/or quaternization products thereof in amounts of from about 0.1 to about 50% by weight, preferably from about 1 to about 30% by weight, in particular, from about 2 to about 10% by weight, relative to the final concentration.

Other known emulsifiers include the betaines.

Betaines represent known surfactants which are primarily prepared by carboxyalkylation, preferably carboxylmethylation, of aminic compounds. The starting materials are preferably condensed with halocarboxylic acids or salts thereof, in particular with sodium chloroacetate, one mole of salt being formed per mole of betaine. Furthermore, the addition of unsaturated carboxylic acids, such as, for example, acrylic acid, is also possible. With regard to nomenclature and, in particular, to differentiate between betaines and "true" amphoteric surfactants, reference is made to the contribution by U. Ploog in Seifen-Ole-Fette-Wachse, 108, 373 (1982). Further overviews on this theme are given, for example, by A. O'Lennick et al. in HAPPI, November 70 (1986), S. Holzman et al. in Tens. Surf. Det. 23, 309 (1986), R. Bibo et al. in Soap Cosm. Chem. Spec., April 46 (1990) and P. Ellis et al. in Euro Cosm. 1, 14 (1994). Examples of suitable betaines are the carboxyalkylation products or secondary and in particular tertiary amines which conform to the formula (IV), $$R^7—N^+(R^8)(R^9)—(CH_2)_pCOOA \quad (VII)$$

in which $R^7$ stands for alkyl and/or alkenyl residues having 6 to 22 carbon atoms, $R^8$ stands for hydrogen or alkyl radicals having 1 to 4 carbon atoms, $R^9$ stands for alkyl radicals having 1 to 4 carbon atoms, p stands for a number from 1 to 6, and A stands for an alkali metal and/or alkaline earth metal or ammonium. Typical examples are the carboxymethylation products of hexylmethylamine, hexyldimethylamine, octyldimethylamine, decyldimethylamine, dodecylmethylamine, dodecyldimethylamine, dodecylethylmethylamine, $C_{12/14}$ cocoalkyldimethylamine, myristyldimethylamine, cetyldimethylamine, stearyldimethylamine, stearylethylmethylamine, oleyldimethylamine, $C_{16/18}$ tallow-alkyl-dimethylamine, and industrial mixtures thereof.

Also suitable are carboxyalkylation products of amidoamines, which conform to the formula (VI), $$R^{19}CO—NH—(CH_2)_m—N^+(R^8)(R^9)—(CH_2)_pCOOA \quad (VIII)$$

in which $R^{10}CO$ stands for an aliphatic acyl residue having 6 to 22 carbon atoms and 0 or 1 to 3 double bonds, m stands for a number from 1 to 3, and $R^8$, $R^9$, p, and A have the meanings given above. Typical examples are reaction products of fatty acids having 6 to 22 carbon atoms, namely caproic acid, caprylic acid, capric acid, lauric acid, myristic acid, palmitic acid, palmoleic acid, stearic acid, isostearic acid, oleic acid, elaidic acid, petroselic acid, linoleic acid, linolenic acid, eleostearic acid, arachidic acid, gadoleic acid, behenic acid, and erucic acid, and industrial mixtures thereof with N,N-dimethylaminoethylamine, N,N-dimethylaminopropyl-amine, N,N-diethylaminoethylamine, and N,N-diethylaminopropylamine which are condensed with sodium chloroacetate. Preference is given to the use of a condensation product of $C_{8/18}$ coconut fatty acid-N,N-dimethylaminopropylamide with sodium chloroacetate.

Further suitable starting materials are imidazolines, which conform to the formula (X),

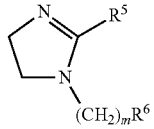

(X)

in which $R^5$ stands for an alkyl radical having 5 to 21 carbon atoms, $R^6$ stands for a hydroxy group, an $OCOR^5$, or $NHCOR^5$ residue, and m stands for 2 or 3. These substances too are known substances which can be obtained, for example, by cyclizing condensation of 1 or 2 mol of fatty acid with polyfunctional amines, such as, for example, aminoethylethanolamine (AEEA) or diethylenetriamine. The corresponding carboxyalkylation products are mixtures of different open-chain betaines. Typical examples are condensation products of the abovementioned fatty acids with AEEA, preferably imidazolines based on lauric acid or again $C_{12/14}$ coconut fatty acid, which are then betainized with sodium chloroacetate.

The compositions according to the present disclosure may contain the betaines in amounts of from about 0.1 to about 50, preferably from about 1 to about 30% by weight, in particular, from about 2 to about 10% by weight, relative to the final concentration.

The compositions according to the present disclosure may contain combinations of non-ionic emulsifiers with other non-ionic emulsifiers, anionic emulsifiers, and/or cationic emulsifiers, wherein the HLB value of the emulsifier mixture of the (at least one) first and (at least one) second emulsifier is at least about 12.0, preferably at least about 14.0, most preferably at least about 15.0. Preferably, the ratio of the first emulsifier to the second emulsifier is from about 0.9-0.1 to about 0.9-0.1. In an especially preferred embodiment, the second emulsifier is also a non-ionic emulsifier.

In various embodiments, the agent according to the present disclosure also contains at least one non-aqueous solvent selected from (poly)alkylene glycols or alcohols, e.g., from the group of monohydric or polyhydric alcohols. Alkanolamines or glycol ethers are also suitable, provided that they are miscible in water in the concentration range that is used. The solvents are preferably selected from ethanol, n- or i-propanol, butanols, glycol, propanediol, butanediol, glycerol, diglycol, propyl diglycol, butyl diglycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol methyl ether, dipropylene glycol ethyl ether, methoxytriglycol, ethoxytriglycol, butoxytriglycol, 1-butoxyethoxy-2-propanol, 3-methyl-3-methoxybutanol, propylene glycol t-butyl ether, and mixtures of these solvents. In preferred embodiments, the at least one non-aqueous solvent is selected from ethanol, propylene glycol, dipropylene glycol, glycerol, and isopropanol.

In other embodiments, the agents of the present disclosure furthermore contain at least one hydrotropic substance. Suitable hydrotropic substances within the meaning of the present disclosure include, in particular, aromatic alkylsulfonates, such as, in particular, toluenesulfonates, cumenesulfonates, xylenesulfonates, and so forth. In various embodiments, the at least one hydrotropic substance is, in particular, an aromatic alkyl sulfonic acid or an ester or salt thereof, preferably selected from p-toluenesulfonic acid methylester, p-toluenesulfonic acid monohydrate, and p-cumene sulfonic acid or the corresponding salts, in particular, the sodium salts.

The liquid composition has, in various embodiments, a viscosity of from about 100 to about 300 mPas (20° C.), the viscosity being measured with a DV-II viscometer from the company Brookfield with spindle 2 at 20 rpm.

In addition to the combination according to the present disclosure of esterquats, thickeners, and aminosiloxanes as well as—optionally—emulsifiers, hydrotropic substances, and non-aqueous solvents, the agents according to the present disclosure may contain other ingredients that further improve the properties for industrial use and/or esthetic properties of the composition, depending on the intended purpose, e.g., as a fabric care agent or as a softener.

Within the scope of the present disclosure, preferred compositions additionally contain at least one substance selected from the group of electrolytes, pH adjusting agents, fragrances, perfume carriers, fluorescing agents, dyes, other hydrotropic substances, suds suppressors, anti-redeposition agents, enzymes, optical brighteners, graying inhibitors, shrink preventers, anti-crease agents, dye transfer inhibitors, antimicrobial active ingredients, germicides, fungicides, antioxidants, corrosion inhibitors, antistatic agents, ironing aids, repellants and impregnating agents, swelling and anti-slip agents, cationic polymers, and UV absorbers.

A broad range of various salts can be used as electrolytes from the group of inorganic salts. Preferred cations are the alkali and alkaline earth metals, and preferred anions are the halides and sulfates. For industrial preparation-related reasons, it is preferable to use NaCl or $MgCl_2$ in the agents according to the present disclosure.

In order to bring the pH value of the agents according to the present disclosure into the desired range, the use of pH adjusting agents may be appropriate. All known acids or alkalis can be used here provided, that use thereof is not prohibited for reasons relating to performance characteristics or ecological reasons or consumer protection reasons. Usually, the amount of these adjusting agents does not exceed 1% by weight of the total formulation.

Dyes and fragrances are added to the agents according to the present disclosure in order to improve the aesthetic impression created by the products and to provide the consumer not only with the required washing performance but also with a visually and sensorially "typical and unmistakable" product. Suitable perfume oils or fragrances include individual odorant compounds, for example, the synthetic products of the ester, ether, aldehyde, ketone, alcohol, and hydrocarbon type. Odorant compounds of the ester type are, for example, benzyl acetate, phenoxyethyl isobutyrate, p-tert-butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes, for example, the linear alkanals having 8-18 to 18 carbon atoms, citral, citronellal, citronellyloxyacetaldehyde, cyclamenaldehyde, hydroxycitronellal, lilial, and bourgeonal; the ketones, for example, the ionones, α-isomethylionone, and methyl cedryl ketone; the alcohols, anethole, citronellol, eugenol, geraniol, linalool, phenylethyl alcohol, and terpineol; and the hydrocarbons include principally the terpenes such as limonene and pinene. It is, however, preferable to use mixtures of different odorants which together produce an appealing odorous note. Such perfume oils may also contain natural odorant mixtures such as those available from plant sources, for example pine, citrus, jasmine, patchouli, rose, or ylang ylang oil. Also suitable are muscat, sage oil, chamomile oil, clove oil, melissa oil, mint oil, cinnamon leaf oil, lime blossom oil, juniper berry oil, vetiver oil, olibanum oil, galbanum oil, and labdanum oil, as well as orange blossom oil, neroli oil, orange peel oil, and sandalwood oil.

Usually, the dye content is below 0.01% by weight, whereas fragrances may constitute up to about 2% by weight of the total formulation.

The fragrances may be directly incorporated in the agents according to the present disclosure, but it may also be of advantage to fragrances the perfumes to carriers which strengthen the adherence of the perfume to the wash and which provide the textiles with a long-lasting fragrance through a slower release of the fragrance. Suitable carrier materials are, for example, cyclodextrins, the cyclodextrin/perfume complexes optionally being coated with other auxiliaries.

It should be noted that the perfume oils to be incorporated into the liquid formulations according to the present disclosure are readily emulsifiable, in order to be able to ensure the desired clear, transparent consistency of the formulation according to the present disclosure.

The agents according to the present disclosure may, in order to improve the aesthetic impression thereof, be colored with suitable dyes. Preferred dyes, which are not difficult for a person skilled in the art to choose, have high stability in storage, are not affected by the other ingredients of the agents or by light, and do not have any pronounced substantivity for textile fibers so as not to color them.

Suitable suds suppressors that can be used in the agents according to the present disclosure are, for example, soaps, paraffins, or silicone oils, which if applicable can be applied onto carrier materials. Examples of suitable anti-redeposition agents—also called soil repellents—include non-ionic cellulose ethers such as methyl cellulose and methylhydroxypropyl cellulose having a proportion of methoxy groups of from about 15 to about 30% by weight and hydroxypropyl groups of from about 1 to about 15% by weight, respectively relative to the non-ionic cellulose ethers, as well as the polymers of phthalic acid and/or terephthalic acid or derivatives thereof that are known in the prior art, in particular, polymers made of ethylene terephthalates and/or polyethylene glycol terephthalates, or anionically and/or non-ionically modified derivatives thereof. The sulfonated derivatives of phthalic acid and terephthalic acid polymers are especially preferred among these.

In addition, hydrotropic substances, for example ethanol, isopropyl alcohol or polyols, may be used to improve flow behavior. Suitable polyols preferably contain 2 to 15 carbon atoms and at least two hydroxy groups. The polyols may contain other functional groups, more especially amino groups, or may be modified with nitrogen. Typical examples are:

glycerol;

alkylene glycols such as, for example, ethylene glycol, diethylene glycol, propylene glycol, butylene glycol, hexylene glycol, and polyethylene glycols having an average molecular weight of 100 to about 1000 dalton;

industrial oligoglycerol mixtures having a degree of self-condensation of from about 1.5 to about 10 such as, for example, industrial diglycerol mixtures having a diglycerol content of from about 40 to about 50% by weight;

methylol compounds such as, in particular, trimethylol ethane, trimethylol propane, trimethylol butane, pentaerythritol, and dipentaerythritol;

lower alkyl glucosides, particularly those containing 1 to 8 carbon atoms in the alkyl residue, for example methyl and butyl glucoside;

sugar alcohols containing 5 to 12 carbon atoms, for example sorbitol or mannitol;

sugars containing 5 to 12 carbon atoms, for example glucose or sucrose;

amino sugars, for example glucamine;

dialcoholamines, such as diethanolamine or 2-amino-1,3-propanediol.

Particularly suitable enzymes are those from the classes of hydrolases, such as the proteases, esterases, lipases or lipolytic enzymes, amylases, cellulases and other glycosyl hydrolases and mixtures of said enzymes. During washing, all these hydrolases contribute to the removal of spots, such as protein-, fat- or starch-containing spots, and graying. Cellulases and other glycosyl hydrolases can also contribute to color preservation and to an increase in the softness of the textile by removing pilling and microfibrils. For bleaching or for inhibiting color transfer, it is also possible to use oxidoreductases. Enzymatic active substances obtained from bacterial strains or fungi, such as *Bacillus subtilis, Bacillus licheniformis, Streptomyceus griseus* and *Humicola insolens*, are particularly suitable. Proteases of the subtilisin type and in particular proteases which are obtained from *Bacillus lentus* are preferably used. Enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase, or lipolytic enzymes and cellulase, but in particular protease and/or lipase-containing mixtures or mixtures with lipolytic enzymes are of particular interest. Examples of such lipolytic enzymes are the known cutinases. Peroxidases or oxidases have also proven suitable in some cases. The suitable amylases include, in particular, α-amylases, isoamylases, pullulanases, and pectinases. Preferably used cellulases are cellobiohydrolases, endoglucanases, and β-glucosidases, which are also referred to as cellobiases, or mixtures thereof. Since different cellulase types differ in their CMCase and avicelase activities, the desired activities can be established by controlled mixing of the cellulases.

The enzymes may have been adsorbed on carrier substances or embedded into coating substances in order to protect them from premature decomposition. The proportion of enzymes, enzyme mixtures, or enzyme granulates may be, for example, from approximately 0.1 to about 5% by weight, preferably from about 0.12 to approximately 2% by weight.

Optical brighteners (so-called "whiteners") can be added to the agents according to the present disclosure in order to eliminate graying and yellowing of the treated textiles. These substances are absorbed onto the fiber and result in brightening and a simulated bleaching effect by converting invisible ultraviolet radiation into visible longer-wave light, the ultraviolet light absorbed from sunlight being radiated as slightly bluish fluorescence and, with the yellow hue of the grayed or yellowed laundry, giving pure white. Suitable compounds originate, for example, from the classes of substances including 4,4'-diamino-2,2'-stilbenedisulfonic acids (flavonic acids), 4,4'-distyrylbiphenyls, methylumbelliferones, cumarins, dihydroquinolinones, 1,3-diarylpyrazolines, naphthalimides, benzoxazole, benzisoxazole and benzimidazole systems and the pyrene derivatives substituted by heterocycles. The optical brighteners are usually used in amounts between about 0.1 and about 0.3% by weight relative to the ready agent.

Graying inhibitors have the function of keeping the dirt detached from the fiber in suspension in the liquor and thus preventing reabsorption of the dirt. Water-soluble colloids, generally organic in nature, are suitable for this purpose, for example, the water-soluble salts of polymeric carboxylic acids, sizing material, gelatins, salts of ethersulfonic acids of starch or of cellulose or salts of acidic sulfuric esters of cellulose or of starch. Water-soluble polyamides containing acidic groups are also suitable for this purpose. Furthermore, soluble starch preparations and starch products other than those mentioned above may be used, for example degraded starch, aldehyde starches, etc. Polyvinylpyrrolidone can also be used. However, cellulose ethers, such as carboxymethylcellulose (Na salt), methylcellulose, hydroxyalkylcellulose, and mixed ethers, such as methylhydroxyethylcellulose, methylhydroxypropylcellulose, methylcarboxymethylcellulose, and mixtures thereof, are preferably used in amounts from about 0.1 to about 5% by weight, based on the agent.

Since textile surface structures, in particular of rayon, rayon staple, cotton, and blends thereof, may tend to crease because the individual fibers are sensitive to bending or flexing, pressing and squeezing transversely to the fiber direction, the agents according to the present disclosure may contain synthetic anti-crease agents. These include, for example, synthetic products based on fatty acids, fatty esters, fatty amides, fatty alkylol esters, fatty alkylolamides or fatty alcohols, which have generally been reacted with ethylene oxide, or products based on lecithin or modified phosphoric esters.

For controlling microorganisms, the agents according to the present disclosure may contain antimicrobial active ingredients. Depending on the antimicrobial spectrum and action mechanism, a distinction is made here between bacteriostatic agents and bactericides, fungistatic agents and fungicides, etc. Important substances from these groups are, for example, benzalkonium chlorides. Preferred compounds within the scope of the present disclosure are, for example, alkylarylsulfonates, halophenols and phenol mercuriacetate, it also being possible to completely dispense with these compounds in the agents according to the present disclosure.

In order to prevent undesired changes to the agents and/or the treated textiles which are due to the action of oxygen and other oxidative processes, the agents may contain antioxidants. This class of compounds includes, for example, substituted phenols, hydroquinones, pyrocatechols, and aromatic amines and organic sulfides, polysulfides, dithiocarbamates, phosphites, and phosphonates.

Greater comfort during wear can result from the additional use of antistatic agents, which are also added to the agents according to the present disclosure. Antistatic agents increase the surface conductivity and hence permit improved flowing away of resulting charges. External antistatic agents are generally substances that have at least one hydrophilic molecule ligand and give a more or less hygroscopic film on the surfaces. These generally surface-active antistatic agents can be divided into nitrogen-containing (amines, amides, quaternary ammonium compounds), phosphorus-containing (phosphoric acid esters) and sulfur-containing (alkylsulfonates, alkylsulfates) antistatic agents. External antistatic agents are described, for example, in the patent applications FR 1,156,513, GB 873 214, and GB 839 407. The lauryl- (or stearyl)dimethylbenzylammonium chlorides disclosed here are suitable as antistatic agents for textiles or as an additive to washing agents, a reviving effect additionally being achieved.

"Cationic polymers" within the meaning of the present disclosure are polymers that carry a positive charge in the polymer molecule. This charge can be implemented, for example, by way of (alkyl)ammonium groupings or other positively charged groups that are present in the polymer chain. Particularly preferred cationic polymers come from the groups of quaternized cellulose derivatives, polysiloxanes having quaternary groups, cationic guar derivatives, polymeric dimethyldiallylammonium salts and the copolymers thereof with esters and amides of acrylic acid and methacrylic acid, copolymers of vinylpyrrolidone with quaternized derivatives of dialkylaminoacrylate and -methacrylate, vinylpyrrolidone/methoimidazolinium chloride copolymers, quaternized polyvinyl alcohols, or the polymers described by the designations Polyquaternium 7, Polyquaternium 10, Polyquaternium 37, and Polyquaternium 47.

Finally, the agents according to the present disclosure may also contain UV absorbers, which are adsorbed onto the treated textiles and improve the light stability of the fibers. Compounds which have these desired properties are, for example, those compounds and derivatives of benzophenone having substituents in the 2- and/or 4-position which are effective as a result of radiationless deactivation. Furthermore, substituted benzotriazoles, acrylates phenyl-substituted in the 3-position (cinnamic acid derivatives), optionally having cyano groups in the 2-position, salicylates, organic Ni complexes, and natural substances, such as umbelliferone and the endogenous urocanic acid, are also suitable.

In order to achieve optimum properties for industrial use and protect the protects from germ attacks, it may be advantageous to add preservatives to the products. Using commercially available preservatives can prevent microorganisms from attacking the fabric softeners according to the present disclosure.

The total proportion of the additives may be from about 1 to about 50% by weight, preferably from about 5 to about 40% by weight, relative to the final product.

The present disclosure also focuses, as described above, on the use of the components (a), (b), and (c) to prepare liquid, clear, homogeneous, and fabric-softening fabric treatment agents and corresponding preparation methods. The formulations described herein can be prepared according to techniques known to a person skilled in the art for preparing fabric care agents and softeners. This may take place, for example, through mixing of the raw materials, optionally with the use of high-shearing mixer apparatuses.

The present disclosure also relates to methods for treating textiles. In such methods, at least one textile is brought into contact with a liquid composition as described herein. Also included is the use of liquid compositions such as are described herein to care for and/or condition textile surface structures.

The embodiments disclosed above in connection with the compositions according to the present disclosure can be readily transferred to the methods and uses according to the present disclosure, and vice versa.

EXAMPLES

The embodiments show that using aminosiloxanes makes it possible to reduce the amount of esterquat in the agents according to the present disclosure, without significantly altering the properties of the agents according to the present disclosure. In particular, all of the agents according to the present disclosure were free of clouding and have favorable viscosity, which prevents formation of filaments.

TABLE 1

| Component | Comparative example % by weight | Example 1 % by weight | Example 2 % by weight | Example 3 % by weight | Example 4 % by weight |
|---|---|---|---|---|---|
| Water | 87.95 | 88.75 | 89.25 | 75.65 | 75.45 |
| Dehyquart AU 77 (EQ) | 4.00 | 3.00 | 2.00 | 2.00 | 1.50 |
| Aminosiloxane | | 0.20 | 0.20 | 0.30 | 0.50 |
| Rheovis CSP | 0.50 | 0.50 | 0.50 | 0.50 | 0.50 |
| Isopropanol | — | — | — | 3.00 | — |
| 1,2-Propylene glycol | 3.00 | 3.00 | 3.00 | — | 2.00 |
| Glycerol | — | — | — | 15.00 | 15.00 |
| Eumulgin CO40 | 3.00 | 3.00 | 4.00 | 2.00 | 3.50 |
| Perfume oil in Eumulgin CO40 | 1.00 | 1.00 | 1.00 | 1.00 | 1.00 |
| Citric acid | 0.50 | 0.50 | — | 0.50 | 0.50 |
| Preservative | 0.048 | 0.048 | 0.048 | 0.048 | 0.048 |
| Dye | 0.002 | 0.002 | 0.002 | 0.002 | 0.002 |
| pH value | 2.2-3.6 | 2.2-3.6 | 2.2-3.6 | 2.2-3.6 | 2.2-3.6 |
| Viscosity (Brookfield DV-I, Spindle 2, 20 U/min, 20° C.) | 100-300 mPas | 100-300 mPas | 100-300 mPas | 100-300 mPas | 100-300 mPas |
| Appearance | Transparent | Transparent | Transparent | Transparent | Transparent |

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A liquid, clear, homogeneous fabric treatment agent comprising:

a. at least one cationic compound obtained by reacting i. a mixture of at least one dicarboxylic acid of formula (I)

(I)

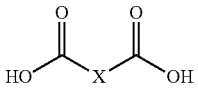

wherein X stands for a saturated or unsaturated hydrocarbon residue having 1 to 8 carbon atoms, and at least one monocarboxylic acid of formula (II)

(II)

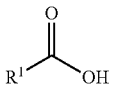

wherein $R^1$ stands for a saturated or unsaturated hydrocarbon residue having 5 to 21 carbon atoms, and ii. at least one tertiary amine of formula (III)

(III)

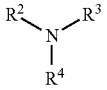

wherein $R^2$, $R^3$, and $R^4$—independently of one another—stand for a $C_2$ to $C_6$ hydroxyalkyl group, and;

iii. at least one quaternizing agent for quaternizing at least one amino group included in the obtained reaction product, and b. at least one non-ionic or cationic thickener, and c. amodimethicone/morpholinomethyl silsesquioxane copolymer.

2. The agent according to claim 1, wherein a. the dicarboxylic acid of formula (I) is selected from the group of succinic acid, maleic acid, glutaric acid, adipic acid, and mixtures thereof; and/or b. the monocarboxylic acid of formula (II) is selected from the group of stearic acid, isostearic acid, palmitic acid, myristic acid, lauric acid, capric acid, caprylic acid, 2-ethylhexanoic acid, 2-octyldodecanoic acid, caproic acid, oleic acid, linoleic acid, linolenic acid, partially-hydrogenated coconut fatty acid, palm fatty acid, palm kernel fatty acid, tallow fatty acid, and mixtures of two, three, or more of the aforementioned acids; and/or c. the molar ratio of the monocarboxylic acid of formula (II) to dicarboxylic acid of formula (I) is in the range of from about 1:1 to about 4:1 and the molar ratio of the alkanolamines of formula (III) to the sum of mono- and dicarboxylic acids is in the range of from about 1:1.2 to about 1:2.4.

3. The agent according to claim 1, wherein the at least one thickener is a non-ionic thickener that is selected from the group of hydroxyethyl cellulose (HEC), hydroxypropyl cellulose (HPC), hydroxypropyl methylcellulose (HPMC), methylcellulose (MC), guar, guar derivatives, and mixtures of the aforementioned non-ionic thickeners.

4. The agent according to claim 1, wherein the at least one thickener is a cationic copolymer that is covalently cross-linked with the use of at least one copolymerizable cross-linking agent with at least two ethylenically unsaturated groups.

5. The agent according to claim 1, wherein the at least one non-ionic or cationic thickener is included in an amount of from about 0.1 to about 10% by weight relative to the total weight of the agent.

6. The agent according to claim 1, wherein the agent comprises at least one emulsifier, wherein the at least one emulsifier is a non-ionic emulsifier and has an HLB value of at least about 12.0.

7. The agent according to claim 1, wherein the agent comprises at least one hydrotropic substance.

8. The agent according to claim 1, wherein the agent comprises at least one non-aqueous solvent selected from (poly)alkylene glycols or alcohols.

9. A method comprising treating fabric with a liquid, clear, homogeneous, and fabric-softening fabric treatment agent, wherein the agent comprises:

a. at least one cationic compound (EQ) obtained by reacting i. a mixture of at least one dicarboxylic acid of formula (I)

(I)

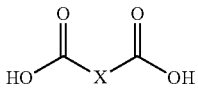

wherein X stands for a saturated or unsaturated hydrocarbon residue having 1 to 8 carbon atoms, and at least one monocarboxylic acid of formula (II)

(II)

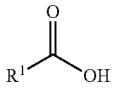

wherein $R^1$ stands for a saturated or unsaturated hydrocarbon residue having 5 to 21 carbon atoms, and ii. at least one tertiary amine of formula (III)

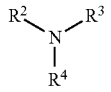

(III)

wherein $R^2$, $R^3$, and $R^4$—independently of one another—stand for a $C_2$ to $C_6$ hydroxyalkyl group, in particular, 2-hydroxyethyl, and;

iii. at least one quaternizing agent for quaternizing at least one amino group included in the obtained reaction product, and b. at least one non-ionic or cationic thickener, and c. amodimethicone/morpholinomethyl silsesquioxane copolymer.

10. The agent according to claim 1, wherein the dicarboxylic acid of formula (I) is selected from the group of succinic acid, maleic acid, glutaric acid, adipic acid, and mixtures thereof.

11. The agent according to claim 1, wherein the monocarboxylic acid of formula (II) is selected from the group of stearic acid, isostearic acid, palmitic acid, myristic acid, lauric acid, capric acid, caprylic acid, 2-ethylhexanoic acid, 2-octyldodecanoic acid, caproic acid, oleic acid, linoleic acid, linolenic acid, partially-hydrogenated coconut fatty acid, palm fatty acid, palm kernel fatty acid, tallow fatty acid, and mixtures of two, three, or more of the aforementioned acids.

12. The agent according to claim 1, wherein a. the dicarboxylic acid of formula (I) is selected from the group of succinic acid, maleic acid, glutaric acid, adipic acid, and mixtures thereof; and b. the monocarboxylic acid of formula (II) is selected from the group of stearic acid, isostearic acid, palmitic acid, myristic acid, lauric acid, capric acid, caprylic acid, 2-ethylhexanoic acid, 2-octyldodecanoic acid, caproic acid, oleic acid, linoleic acid, linolenic acid, partially-hydrogenated coconut fatty acid, palm fatty acid, palm kernel fatty acid, tallow fatty acid, and mixtures of two, three, or more of the aforementioned acids.

13. The agent according to claim 1, wherein the molar ratio of the monocarboxylic acid of formula (II) to dicarboxylic acid of formula (I) is in the range of from about 1.5:1 to 3:1, and the molar ratio of the alkanolamines of formula (III) to the sum of mono- and dicarboxylic acids is in the range of from about 1:1.5 to about 1:1.8.

14. The agent according to claim 4, wherein the at least one copolymerizable cross-linking agent with at least two ethylenically unsaturated groups is selected from divinylbenzene, tetraallylammonium chloride, allyl acrylate, allyl methacrylate, diacrylate compounds of glycols, diacrylate compounds of polyglycols, dimethacrylate compounds of glycols, dimethacrylate compounds of polyglycols, butadiene, 1,7-octadiene, allylacrylamide, allylmethacrylamide, bisacrylamidoacetic acid, N,N'-methylenebisacrylamide, polyol polyallyl ether, and mixtures of two, three, or more of these compounds, and/or has a structure of general formula (IV)

Formel (IV)

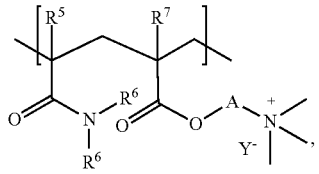

wherein $R^5$, $R^6$, and $R^7$—independently of one another—stand for hydrogen atom or a methyl group, A stands for ethan-1,2-diyl or propan-1,3-diyl, and $Y^-$ stands for an anion.

15. The agent according to claim 4, wherein the at least one copolymerizable cross-linking agent with at least two ethylenically unsaturated groups has a structure of general formula (IV)

Formel (IV)

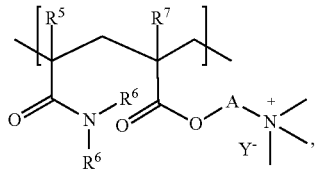

wherein $R^5$, $R^6$, and $R^7$—independently of one another—stand for hydrogen atom or a methyl group, A stands for ethan-1,2-diyl or propan-1,3-diyl, and $Y^-$ stands for an anion.

16. The agent according to claim 6, wherein the at least one emulsifier has an HLB value of at least about 15.0.

17. The agent according to claim 7, wherein the at least one hydrotropic substance is an aromatic alkyl sulfonic acid or an ester or salt thereof.

* * * * *